US007763333B2

(12) United States Patent
Kato et al.

(10) Patent No.: US 7,763,333 B2
(45) Date of Patent: Jul. 27, 2010

(54) INK JET RECORDING MEDIUM

(75) Inventors: Makoto Kato, Tokyo (JP); Masanori Nagoshi, Tokyo (JP); Koji Igarashi, Tokyo (JP); Yuri Watanabe, Tokyo (JP); Hidetsugu Oda, Tokyo (JP); Terufumi Yamaguchi, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 11/991,500

(22) PCT Filed: Sep. 7, 2006

(86) PCT No.: PCT/JP2006/317745

§ 371 (c)(1),
(2), (4) Date: Mar. 5, 2008

(87) PCT Pub. No.: WO2007/029770

PCT Pub. Date: Mar. 15, 2007

(65) Prior Publication Data

US 2009/0123676 A1 May 14, 2009

(30) Foreign Application Priority Data

| | | |
|---|---|---|
| Sep. 7, 2005 | (JP) | 2005-258906 |
| Sep. 29, 2005 | (JP) | 2005-284178 |
| Oct. 11, 2005 | (JP) | 2005-296008 |
| Oct. 18, 2005 | (JP) | 2005-302607 |
| Oct. 27, 2005 | (JP) | 2005-313348 |
| Oct. 31, 2005 | (JP) | 2005-317135 |
| Oct. 31, 2005 | (JP) | 2005-317136 |

(51) Int. Cl.
*B41M 5/00* (2006.01)

(52) U.S. Cl. ..... 428/32.24; 428/32.25; 428/32.26; 428/32.28; 428/32.31; 428/32.35

(58) Field of Classification Search ..... 428/32.24, 428/32.25, 32.26, 32.28, 32.31, 32.35
See application file for complete search history.

(56) References Cited

U.S. PATENT DOCUMENTS

| | | | | |
|---|---|---|---|---|
| 5,275,846 | A * | 1/1994 | Imai et al. | 427/362 |
| 7,244,478 | B2 | 7/2007 | Kondo et al. | 428/32.24 |
| 2004/0066446 | A1 * | 4/2004 | Yamaguchi et al. | 347/105 |
| 2005/0008794 | A1 * | 1/2005 | Graczyk et al. | 428/32.24 |
| 2005/0069655 | A1 * | 3/2005 | Yamamoto et al. | 428/32.18 |

FOREIGN PATENT DOCUMENTS

| | | | |
|---|---|---|---|
| CN | 1659039 | A | 8/2005 |
| JP | 2938380 | | 6/1999 |
| JP | 2000-141868 | | 5/2000 |
| JP | 2000-211248 | | 8/2000 |
| JP | 2001-10220 | | 1/2001 |
| JP | 2001-71635 | | 3/2001 |
| JP | 2003-231342 | | 8/2003 |
| JP | 2004-330725 | | 11/2004 |
| JP | 2005-305686 | | 11/2005 |
| WO | WO 03/101745 | A1 | 12/2003 |
| WO | WO 03/101746 | A1 | 12/2003 |

OTHER PUBLICATIONS

Kunio Nohara; "Ink Jet Gloss Paper According to Casting Method (1);" *Convertech*; vol. 32; No. 11; Nov. 2004; pp. 61-65.
Kunio Nohara; "Ink Jet Gloss Paper According to Casting Method (2);" *Convertech*; vol. 32; No. 12; Dec. 2004; pp. 46-52.
Kunio Nohara; "Ink Jet Gloss Paper According to Casting Method (3);" *Convertech*; vol. 33; No. 1; Jan. 2005; pp. 43-48.
Chinese Office Action dated Jun. 26, 2009, with English Translation.

* cited by examiner

*Primary Examiner*—Betelhem Shewareged
(74) *Attorney, Agent, or Firm*—Kratz, Quintos & Hanson, LLP

(57) ABSTRACT

This invention provides an ink jet recording medium, which is small in coverage and, at the same time, can simultaneously realize high gloss and ink absorption. The ink jet recording medium is produced by coating a lower layer comprising a water-absorptive pigment, a latex, and boric acid or its salt and an upper layer comprising a submicron pigment and polyvinyl alcohol, and conducting casting.

15 Claims, No Drawings

INK JET RECORDING MEDIUM

TECHNICAL FIELD

The present invention relates to an ink jet recording medium, and particularly to an ink jet recording medium which has high gloss and ink absorption even when the coverage of coating is small.

BACKGROUND ART

With recent rapid progress of technology on ink jet printers, there can be obtained records having image quality equal to or higher than that of the records obtained by general silver halide photographic process. Thus, ink jet recording media are also required to have the texture similar to those which are used for silver halide photographic process. As ink jet recording media meeting the above requirement, there are used those which comprise a substrate such as paper or plastic film and a porous ink absorbing layer provided thereon.

As ink jet recording media having gloss, cast-coated papers disclosed in Non-Patent Documents 1-3 have been used. The Non-Patent Document 2 refers to Patent Documents 1-3 as specific embodiments. However, as pointed out in Non-Patent Document 3 (page 43), recording media prepared by the technologies proposed in the above Patent Documents are below the level of photographic papers used for silver halide photography from the point of feeling. This is because when an ink jet recording medium is produced by the above technologies, it is necessary for obtaining sufficient ink absorption to employ an embodiment causing formation of fine cracks on the surface of the recording medium, which damage the texture of the surface.

For solving the problems, Patent Document 4 proposes to produce an ink jet recording medium by curing the coat with electron rays. However, the electron radiation curing apparatus is generally of large-scale, and maintenance and control thereof are troublesome, and besides high administration is required from the viewpoint of labor safety.

Under the circumstances, Patent Document 5 proposes a method for producing an ink jet recording medium by coating a lower layer comprising a pigment and a binder, then providing an intermediate layer containing boric acid, and coating thereon an upper layer comprising a submicron pigment and a binder such as polyvinyl alcohol to be crosslinked with boric acid. According to this method, less cracks occur on the surface of the upper layer, and there can be obtained gloss feeling of the same level as of photographic papers used for silver halide photography.

However, when an ink jet recording medium is produced by this method, a very thick coating layer must be provided for obtaining sufficient gloss or ink absorption, and, for example, in Examples of Patent Document 5, the coat has a thickness of 35 g/m$^2$ in total of the lower layer and the upper layer. It is economically not preferred to provide a coat of such a large coverage on a substrate, and there are further problems that the coat is apt to peel off (to form dusts), which requires careful handling as compared with recording by silver halide photographic process.

Patent Document 5 further discloses that it is preferred to provide the upper layer while the coating composition for the intermediate layer has a specific moisture content. As a result of detailed investigation in this respect by the inventors, it has been found that when moisture content in the intermediate layer is low, gloss of the surface after casting is insufficient. That is, when an ink jet recording medium is produced by the method proposed in Patent Document 5, degree of drying of the coating composition for the intermediate layer is affected by the factors such as temperature and humidity of production site and slight variation in water absorption of the lower layer, which finally unavoidably affects the gloss feeling of the resulting ink jet recording medium.

Patent Document 1: JP-A-2001-010220

Patent Document 2: JP-A-2001-071635

Patent Document 3: Japanese Patent No. 2938380

Patent Document 4: JP-A-2004-330725

Patent Document 5: JP-A-2003-231342

Non-Patent Document 1: Kunio Nohara, "Ink Jet Gloss Paper According to Casting Method (1)", Convertech, Vol. 32, No. 11, Page 61

Non-Patent Document 2: Kunio Nohara, "Ink Jet Gloss Paper According to Casting Method (2)", Convertech, Vol. 32, No. 12, Page 46

Non-Patent Document 3: Kunio Nohara, "Ink Jet Gloss Paper According to Casting Method (3)", Convertech, Vol. 33, No. 1, Page 43

DISCLOSURE OF INVENTION

Problem to be solved by the Invention

The object of the present invention is to provide an ink jet recording medium small in coverage of coating, high in gloss and sufficient in ink absorption, which have hitherto been hardly realized.

Means for Solving the Problem

As a result of research conducted for solving the problem, it has become possible to obtain an ink jet recording medium small in coverage of coating and having both high gloss and sufficient ink absorption by coating successively on an air permeable support a lower layer coating composition mainly composed of a water-absorptive inorganic pigment, a latex and boric acid or a salt thereof, and an upper layer coating composition mainly composed of a submicron pigment and a polyvinyl alcohol and subjecting the coats to casting.

Furthermore, in the present invention, a satisfactory ink absorption can be obtained by using a wet process synthetic silica as the water-absorptive pigment in the lower layer.

Furthermore, in the present invention, further higher gloss and lower dust formation can be obtained by coating and drying the lower layer and thereafter subjecting the lower layer to calendering treatment.

Furthermore, in the present invention, the gloss and low dust formation can be highly balanced with ink absorption by controlling the Bekk smoothness to 50-300 seconds in calendering treatment of the lower layer.

Furthermore, in the present invention, higher ink absorption and lower dust formation can be obtained by containing colloidal silica in the lower layer coating composition.

Furthermore, in the present invention, better gloss can be obtained by using a latex of a polyurethane resin as the latex in the lower layer coating composition.

Furthermore, in the present invention, an ink jet recording medium which is further excellent in low dust formation can be obtained by using a latex of a polyurethane resin prepared using a polyether polyol as a starting material as the latex in the lower layer coating composition.

Furthermore, in the present invention, an ink jet recording medium which is excellent particularly in low dust formation can be obtained by using a latex of a polyurethane resin having a tensile strength of 30-70 MPa and an elongation of 300-800% which are specified in JIS K 7311 as the latex in the lower layer coating composition.

Furthermore, in the present invention, an ink jet recording medium which is further excellent in low dust formation can be obtained by using a latex of a polyurethane resin having a particle diameter of 10-60 nm measured by a dynamic light scattering method as the latex in the lower layer coating composition.

Furthermore, in the present invention, an ink jet recording medium which is excellent particularly in gloss can be obtained by using an alumina hydrate as the submicron pigment in the upper layer coating composition and carrying out casting by a rewet method.

Furthermore, in the present invention, when an alumina hydrate is used as the submicron pigment in the upper layer coating composition and casting is carried out by rewet method, higher gloss and frictional resistance can be obtained by carrying out calendering treatment after coating and drying the upper layer.

Furthermore, in the present invention, when an alumina hydrate is used as the submicron pigment in the upper layer coating composition and casting is carried out by a rewet method after coating and drying the upper layer and subsequent calendering treatment, both the gloss and the frictional resistance can be attained with high balancing by adjusting the Bekk smoothness of the surface of the upper layer to 50-300 seconds after subjected to the calendering treatment.

Furthermore, in the present invention, when an alumina hydrate is used as the submicron pigment in the upper layer coating composition and casting treatment is carried out by a rewet method, an ink jet recording medium high in frictional resistance can be obtained by carrying out the rewetting treatment with an aqueous liquid containing colloidal silica.

Furthermore, in the present invention, when an alumina hydrate is used as the submicron pigment in the upper layer coating composition and rewet casting treatment is carried out by rewetting treatment with an aqueous liquid containing colloidal silica, an ink jet recording medium which is further higher in gloss and frictional resistance can be obtained by carrying out the rewetting treatment with an aqueous liquid containing anionic colloidal silica.

Furthermore, in the present invention, an ink jet recording medium excellent in print density and low dust formation can be obtained by containing a cationic aqueous dispersion of at least one resin selected from (1) (meth)acrylate ester polymers, (2) styrene-(meth)acrylate ester copolymers and (3) polyurethanes in the upper layer coating composition, said dispersion having a particle diameter of 150 nm or less measured by dynamic light scattering method.

Furthermore, in the present invention, an ink jet recording medium which is excellent particularly in ink absorption can be obtained by containing a cationic resin in the support.

ADVANTAGES OF THE INVENTION

According to the present invention, it has become possible to obtain an ink jet recording medium of high quality having both high gloss and sufficient ink absorption even with small coverage of coating, which has not been obtained up to now.

BEST MODE FOR CARRYING OUT THE INVENTION

In the present invention, paper is generally used as an air permeable support, and if necessary, supports other than paper, such as nonwoven fabrics can also be used.

The pulp constituting the paper (base paper) used as a support in the present invention is not particularly limited, and there may be used, each alone or in optional combination, kraft pulps made from softwood and hardwood, chemical pulps such as sulfite pulp, mechanical pulps such as ground wood pulp, semichemical pulps such as semichemical pulp and chemigroundwood pulp, and besides various pulps made from non-wood fibers such as bagasse, kenaf and straws, and wastepaper pulps.

The base papers used in the present invention can contain fillers, which are not particularly limited. That is, there may be used inorganic pigments such as precipitated calcium carbonate, heavy calcium carbonate, talc, kaolin, calcium sulfate, barium sulfate, and titanium oxide, and various solid or hollow organic white pigments each alone or in optional combination. When content of the fillers is high to some extent, the ink absorption increases, which is preferred, but when it is too high, mechanical strength of the support sometimes deteriorates. Specifically, the content of the fillers in the paper used as a support in the present invention is preferably in the range of 4-25% by mass.

In addition to the above pulps and fillers, the base papers used in the present invention may optionally contain binders, and various chemicals for paper making, such as sizing agent, fixing agent, yield improving agent, cationizing agent, strengthening agent, bluing agent, fluorescent brightener, pH adjustor, ant-foaming agent, pitch control agent, and slime control agent. The above materials are suitably dispersed or dissolved in water, and papers used as a support in the present invention can be produced therefrom using various apparatuses such as Fourdrinier paper machines, twin-wire paper machines, e.g., gap former and hybrid former, cylinder paper machines and combination type paper machines.

Furthermore, the base papers used in the present invention may be subjected to surface sizing treatment with various starches, various surface sizing agents, etc.

The lower layer in the present invention is a coating layer formed nearer to the support of the ink jet recording medium, and the lower layer coating composition is a liquid composition which forms the lower layer upon drying. Furthermore, the upper layer in the present invention is a coating layer formed remoter from the support, and the upper layer coating composition is a liquid composition which forms the upper layer upon drying. These coating compositions are normally used in the form of aqueous liquids prepared by dissolving or dispersing the materials in water. In the present invention, the lower layer and the upper layer are usually adjacent to each other, and one or two or more intermediate layers can be provided between the lower layer and the upper layer so long as the interaction of the lower layer and the upper layer is not strongly hindered. Furthermore, one or two or more coating layers can also be provided between the lower layer and the support and between the upper layer and the surface of the recording medium.

The casting treatment in the present invention is a treatment of pressing a coating layer in wet state onto a heated specular surface to transfer the specular surface to the surface of the coating layer and simultaneously removing water from the coating layer by drying to impart gloss to the recording medium. For the casting treatment, there is usually employed an apparatus having a structure to continuously press a web to be treated onto outer periphery of a heated metal cylinder by an elastic roll made of rubber or the like and peel off the web from the cylinder when a desired drying state is attained (Non-Patent Document 2), but other apparatuses which perform the same action as above can also be used.

As non-limiting examples of the casting treatment employed for producing the ink jet recording medium of the present invention, mention may be made of the following methods.

(1) After the coating composition is coated, the coating layer is once dried and then water is applied to the coating layer, followed by pressing the coating layer to a specular surface of a casting apparatus (rewet method).

(2) The upper layer coating composition or the upper layer and lower layer coating compositions are coated, followed by pressing the coating layer as it is without drying onto a specular surface of a casting apparatus (wet method (direct method)).

(3) The upper layer coating composition or the upper layer and lower layer coating compositions are coated, followed by partially drying the coating layer by removing water and then pressing the coating layer in half-drying state onto a specular surface of a casting apparatus.

The water-absorptive pigments in the present invention are pigments having water absorbability, and examples of the pigments are heavy calcium carbonate, precipitated calcium carbonate, wet process synthetic silica, diatomaceous earth, calcium silicate, talc, magnesium hydroxide, halloysite, activated clay, acid clay, hydrotalcite, alumina hydrate, aluminum hydroxide, bentonite clay, zeolite, kaolin, calcined kaolin, gypsum, titanium oxide, barium sulfate, etc. Of these pigments, preferred are those having an oil absorption of 1 mL/g or more specified in JIS K 5101 because recording media having good ink absorption can be obtained.

Of these water-absorptive pigments, especially preferred is wet process synthetic silica because ink jet recording media having good ink absorption even with a small coverage of coating can be obtained. The wet process synthetic silica in the present invention is porous silicon dioxide obtained by mixing a silicate such as sodium silicate with an acid such as sulfuric acid, followed by subjecting the mixture to washing, aging, grinding, etc. As main processes for preparation thereof, precipitation process and gel process are known, and both processes are preferred for the lower layer coating composition in the present invention.

The oil absorption of the wet process synthetic silica used for the lower layer coating composition of the present invention is preferably higher from the viewpoint of ink absorption, but if the oil absorption is too high, dusts are apt to occur at the time of cutting, which is not preferred. Specifically, the oil absorption of the wet process synthetic silica used for the lower layer coating composition of the present invention is preferably 1-5 mL/g, more preferably 2-4 mL/g. As for the particle diameter of the wet process synthetic silica used for the lower layer coating composition of the present invention, if it is too small, viscosity of the coating composition increases and coating operation becomes difficult, which is not preferred, and if it is too large, it is sometimes difficult to develop gloss of recording medium after the casting treatment, which is also not preferred. Specifically, it is preferred that the particle diameter of the wet process synthetic silica used for the lower layer coating composition of the present invention is preferably 2-20 μm, more preferably 3-15 μm as measured by a Malvern method.

The latex in the present invention means a liquid material comprising water in which substantially water-insoluble thermoplastic polymer compound is dispersed, and this is distinguished from aqueous solution of a water-soluble polymer compound in that the former does not substantially dissolve even in hot water after being dried. The particle diameter of the polymer compound in water is usually 500 nm or less. Examples of the latex usable in the lower layer coating composition in the present invention are aqueous dispersions of synthetic polymer compounds such as vinyl acetate resin, ethylene-vinyl acetate resin, (meth)acrylate ester resin, styrene-(meth)acrylate ester resin, styrene-butadiene resin, acrylonitrile-butadiene resin, isoprene resin, chloroprene resin, polyurethane resin, and copolymers comprising these polymers combined in the form of graft or block, natural rubber latexes, etc. In the present invention, for example, the vinyl acetate resin means a resinous polymer mainly composed of vinyl acetate, and includes not only a homopolymer, but also a copolymer comprising vinyl acetate as a main component and one or more other monomers. These latexes may be used each alone or in combination of two or more.

In the present invention, as for the amount of latex added to the lower layer coating composition, when it is too small, dusts are sometimes apt to be produced at the time of cutting of the ink jet recording medium, and when it is too large, ink absorption is sometimes insufficient or gloss after casting treatment is sometimes not sufficiently obtained. Therefore, the amount is such that the mass ratio of latex/(water-absorptive pigment+colloidal silica) is preferably 10/100-60/100, more preferably 15/100-40/100.

In the present invention, as the latex used in the lower layer coating composition, a latex of polyurethane resin is particularly preferred because especially high gloss can be obtained. The polyurethane resin in the present invention is a polymer obtained by addition polymerization of a compound having two or more isocyanate groups and a compound having two or more functional groups having active hydrogen, such as alcoholic hydroxyl group, phenolic hydroxyl group or amino group, and it includes also a polymer in which the bond obtained by the reaction of isocyanate with active hydrogen is a bond other than urethane bond, such as an urea bond.

The compounds having two or more active hydrogens used for polyurethane resin include compounds such as polyester polyols, polyether polyols, polycarbonate polyols, polyacetal polyols, polyacrylate polyols, polyamide polyols, and polybutadiene polyols, which may be used each alone or in combination of two or more.

Some ink jet printers have a mechanism for cutting web-like ink jet recording medium into sheets by a cutter after completion of printing. Since a precision mechanism such as a printing head may be adversely affected by the dusts, papers used in printers having a cutting mechanism are required to form substantially no dusts at the time of cutting. As the latex of polyurethane resin used in the lower layer coating composition, a latex of polyurethane prepared by using a polyether polyol as a starting material is preferred because less dusts are formed.

As the polyether polyols used as a starting material for the polyurethane resins in the present invention, there may be used polymers obtained, for example, by ring opening polymerization of one or more of cyclic ethers such as ethylene oxide, propylene oxide, butylene oxide, tetrahydrofuran and styrene oxide using a suitable catalyst. These may be used each alone or in combination of two or more.

In the present invention, both the high gloss and the low dust formation can be simultaneously attained by using a latex comprising polyurethane resin having a tensile strength of 30-70 MPa and an elongation of 300-800% as the latex of the lower layer. If the tensile strength is more than 70 MPa or the elongation is less than 300%, development of gloss after casting treatment is sometimes insufficient. On the other hand, if the tensile strength is less than 30 MPa or the elongation is more than 800%, the satisfactory low dust formation can hardly be attained.

In the present invention, tensile strength and elongation of polyurethane resin are measured by the methods specified in JIS K 7311, and the specimen used for the test is cut out from a film obtained by spreading the latex on a polyester film in such a manner that the thickness after drying is 150 μm, followed by drying at 23° C. and 65% RH for 24 hours, and then at 150° C. for 5 minutes to obtain the film.

Further satisfactory low dust formation can be attained by using a polyurethane resin latex having a particle diameter of 10-60 nm measured by dynamic light scattering method. If the particle diameter is smaller than 10 nm, the resulting ink jet recording medium sometimes deteriorates in ink absorption.

As for the amount of boric acid or a salt thereof added to the lower layer coating composition which may depend on pH of the coating composition, if it is too small, cracks may occur in the upper layer after drying to cause deterioration in gloss, and if it is too large, dusts are apt to be generated at the time of cutting of the coating layer. Specifically, the amount is preferably 0.2-10% by mass with respect to the water-absorptive pigment in terms of $H_3BO_3$ based on number of moles of boron.

In the present invention, further higher gloss and satisfactory low dust formation can be obtained by subjecting the support having a lower layer and an upper layer to calendering after coating of the lower layer and before the coating of the upper layer.

As calendering apparatuses used in the present invention, soft-calendering apparatus and super-calendering apparatus are representative, but there may also be used gloss-calendering apparatus, shoe-calendering apparatus, etc. If the Bekk smoothness of the surface of lower layer after calendering treatment conducted after coating of the lower layer is too low, the effects to improve gloss and low dust formation by the calendering treatment are sometimes insufficient, and if it is too high, the ink absorption sometimes sharply decreases, and therefore the smoothness is preferably controlled to 50-300 seconds by adjusting the conditions such as nip pressure, temperature and treating speed.

In the present invention, the lower layer coating composition preferably contains colloidal silica because an ink jet recording medium excellent especially in ink absorption and low dust formation can be obtained. The colloidal silica in the present invention is an aqueous dispersion of silicic acid polymer produced by allowing an acid such as sulfuric acid to act on an aqueous silicate solution such as of sodium silicate or removing metallic ions from the aqueous solution with a cation exchange resin, followed by subjecting to aging, and it comprises spherical silicic acid particles having a particle diameter of usually 10-200 nm.

When the specific surface area of colloidal silica used in the lower layer coating composition is too small, the effect to improve low dust formation may be insufficient, and when it is too large, the ink absorption may be deteriorated. Therefore, the specific surface area measured by BET method is preferably 50-500 $m^2/g$, more preferably 100-400 $m^2/g$. Furthermore, when the amount of colloidal silica in the lower layer coating composition of the present invention is too small, the effect to improve the ink absorption is sometimes insufficient, and when it is too large, the gloss sometimes difficult to be developed after casting treatment. Therefore, the amount colloidal silica is preferably 10-100% by mass, more preferably 15-60% by mass based on the amount of water-absorptive pigment.

To the lower layer coating composition of the present invention there may be added water-soluble polymer compounds such as polyoxyethylene, vinylpyrrolidone polymers, (meth)acrylic acid polymers and salts thereof and (meth) acrylamide polymers, water-soluble cellulose ethers such as methyl cellulose and hydroxyethyl cellulose, and water-soluble polymer compounds such as starch, or water-soluble polymer compounds comprising these polymers combined in the form of random, graft or block. However, if the amount of the water-soluble polymer compounds contained in the lower layer coating composition is too large, ink absorption of the resulting ink jet recording medium may extremely deteriorate. The amount of the water-soluble polymer compounds contained in the lower layer coating composition is preferably 5% by mass or less based on the amount of water-absorptive pigment. Particularly, a water-soluble polymer compound having high crystallinity, such as polyvinyl alcohol, causes conspicuous deterioration of gloss of the ink jet recording medium obtained after casting treatment, and it is preferred that substantially no such compound is contained.

The submicron pigment in the present invention means such an inorganic pigment that when a dispersion thereof is sprayed on a suitable substrate such as glass and observed with a scanning electron microscope, particles having a length of long side of 1 μm or less occupy 80% or more of the area occupied by particles in the field of observation. The submicron pigment used in the upper layer coating composition is not particularly limited, and examples thereof are gel process silica, precipitation process silica, colloidal silica, gas phase process silica, gas phase process alumina, pseudo-boehmite, etc. Especially high surface gloss can be obtained by using inorganic pigment in which particles having a length of long side of 400 nm or less occupy 80% or more of the area occupied by particles in the field of observation, and use of such inorganic pigment is preferred. Furthermore, in the case of using inorganic pigment in which particles having a length of long side of 100 nm or more occupy 80% or more of the area occupied by particles in the field of observation, there hardly occur defects such as cracking of coating layer even if the coat of the upper layer coating composition is rapidly dried after coating.

When submicron pigment having a specific surface area of more than a certain degree is used in the upper layer coating composition of the present invention, high print density can be obtained, but when inorganic pigment having too large specific surface area is used, ink absorption sometimes deteriorate. Specifically, the specific surface area of the pigment measured by BET method is preferably 60-600 $m^2/g$, and more preferably 90-400 $m^2/g$.

In the case of using rewet method for casting treatment in the present invention, it is preferred to use an alumina hydrate as the submicron pigment used in the upper layer coating composition because especially high gloss can be obtained. In the present invention, the alumina hydrate is a compound represented by the compositional formula $Al_2O_3.nH_2O$, which is classified into gibbsite (n=3), bialite (n=3), diaspore (n=1), boehmite (n=1), amorphous alumina hydrate, and the like depending on difference in composition (value of n) or crystal form. The most suitable alumina hydrate used in the present invention is one having a form of so-called pseudo-boehmite which is characterized by having an n of more than 1 and less than 3 and an X-ray diffraction pattern similar to that of boehmite, but broad in respective peaks.

As methods for producing the alumina hydrate used in the present invention, there are hydrolysis of aluminum alkoxide, decomposition of aluminum salt or aluminate by neutralization, and physical properties such as particle diameter, pore volume and specific surface area as submicron pigment can be controlled by changing the conditions such as pH at reaction, reaction temperature, coexisting materials at reaction, aging temperature and aging time. In order to obtain these alumina hydrates as stable submicron particles, usually an acid such as nitric acid, hydrochloric acid, formic acid, acetic acid or lactic acid is added to the dispersion.

During carrying of ink jet recording medium on an ink jet printer, the printing surface is sometimes subjected to friction with the back side of other sheets or various devices in the carrying mechanism. Ink jet printers are usually designed so that adverse effect of the friction on the recording medium can be minimized by optimization of pressure or employment of low friction materials, but marks of friction sometimes remain as differences in texture of the surface in such a recording medium as of high gloss of the present invention. The ink jet recording media are sometimes required not to leave the marks of friction (to have frictional resistance) depending on the use. In the present invention, when rewet method is employed for casting treatment, further higher gloss and simultaneously high frictional resistance can be attained by subjecting the support having the lower layer and the upper layer to calendering treatment after coating of the upper layer and before carrying out the casting, which is preferred.

In the present invention, if the Bekk smoothness of the surface of upper layer after the calendering treatment conducted after coating of the upper layer is too low, the effects to improve gloss and frictional resistance to be attained by calendering treatment are sometimes insufficient, and if it is too high, ink absorption sometimes sharply decreases. Therefore, it is preferred to adjust the conditions such as pressure, temperature and treating speed so that the surface has a Bekk smoothness in the range of 50-300 seconds.

In the present invention, it is preferred to use a wetting liquid containing colloidal silica when rewet method is used for casting treatment and alumina hydrate is used as the submicron pigment used in the upper layer coating composition, because an ink jet recording medium having very high gloss and extremely satisfactory frictional resistance can be obtained.

Especially when anionic colloidal silica having an average primary particle diameter of 40 nm or less measured by dynamic light scattering method is used as the colloidal silica to be added to the wetting liquid, colloidal silica is coalesced with the upper layer, resulting in very high gloss, which is preferred.

As polyvinyl alcohols used in the upper layer coating composition of the present invention, those which have various saponification degrees of from 70 mol % to 100 mol % can be used, and when rewet method is used for casting, it is preferred to use those which have a saponification degree of 95 mol % or more because gloss is easily developed. Furthermore, modified polyvinyl alcohols prepared by introducing various functional groups such as silyl group, carboxyl group, amino group and acetoacetyl group or introducing other monomers such as ethylene in the form of random, graft or block can also be used, and furthermore polyvinyl alcohols increased in viscosity by adding a small amount of a material such as boric acid which allows polyvinyl alcohols to gel can also be used.

If the amount of polyvinyl alcohol added to the upper layer coating composition is too small, cracking may occur during drying or frictional resistance of the resulting ink jet recording medium may be insufficient, and if it is too large, ink absorption may decrease. Specifically, the amount of polyvinyl alcohol is preferably 2-40% by mass, more preferably 5-25% by mass based on the amount of submicron pigment.

The polyvinyl alcohol used in the upper layer coating composition is preferably such as the viscosity of its aqueous solution being higher because cracking hardly occurs during drying of the coat of the coating composition even if the amount of the polyvinyl alcohol is relatively small, and hence the polyvinyl alcohol can be used in a small amount, and as a result, ink absorption can be improved, which is preferred. On the other hand, if the viscosity of the aqueous solution is too high, the viscosity of the coating composition obtained in the present invention becomes too high, and coating operation sometimes becomes difficult. Specifically, viscosity of the aqueous solution of 4% by mass measured using Ubbelohde's viscometer at 25° C. in accordance with JIS Z8803 is preferably 15-400 mPa·sec, more preferably 30-200 mPa·sec. These polyvinyl alcohols may be used each alone or in combination of two more which differ in saponification degree, viscosity of aqueous solution and modification.

The upper layer coating composition of the present invention preferably contains a cationic aqueous dispersion of at least one resin selected from (1) (meth)acrylate ester polymers, (2) styrene-(meth)acrylate ester copolymers and (3) polyurethanes having a particle diameter of 150 nm or less measured by dynamic light scattering method because the higher print density can be obtained. These polymers may be copolymerized with various vinyl monomers, allyl monomers, or the like so long as the effect is not damaged.

If necessary, each coating layer of the present invention can contain various additives such as surface active agents, antifoaming agents, thickening agents, bluing agents, fluorescent brighteners, antioxidants and ultraviolet absorbers.

In the present invention, the method for coating the coating composition of each coating layer is not particularly limited, and there may be employed various coating means such as air-knife coater, blade coater, rod-blade coater, bar coater, reverse-roll coater, comma coater, gate-roll coater, film-transfer coater, lip coater, die coater and curtain coater. Among them, curtain coater is preferred for coating of the coating layers, especially the upper layer coating composition since the resulting coating layer has high uniformity, and besides, in coating of upper layer, the coating composition hardly penetrates into the lower layer to give markedly satisfactory surface quality.

If the coverage of each coating layer is too small, ink absorption is sometimes insufficient, and if it is too large, low dust formation is sometimes deteriorated, and usually it is preferred that the coverage of coating of the upper layer and lower layer is 5-20 g/m$^2$, respectively, and the coverage of coating in total of both layers is 10-30 g/m$^2$. Exceptionally, when especially a large amount of ink is required to be absorbed, for example, when the ink jet printer used for printing applies especially a large amount of ink to the ink jet printing medium, coating of about 50 g/m$^2$ in total of both layers may be sometimes preferred, but even in this case, according to the present invention, with a coverage of coating smaller than in conventional method, equal ink absorption can be obtained, and relatively satisfactory low dust formation can be attained.

A releasing agent comprising an oily material, an aqueous dispersion of oily material, or the like can be added to the coating composition of the present invention for the purpose of improving releasability from the specular surface in the casting apparatus. Furthermore, when coating is carried out before casting treatment or rewet method is used as casting method, stable production can be carried out for a long period of time by adding the releasing agent to water used for the rewetting. Examples of effective materials as components of the releasing agent are higher alkylamines such as dimethyloctylamine and dimethyloctadecylamine or salts thereof, higher alkyl quaternary ammonium salts such as trimethyloctylammonium chloride and trimethyloctadecylammonium chloride, higher carboxylic acids such as oleic acid, stearic acid and caprylic acid or salts thereof, higher alcohols such as octyl alcohol and octadecyl alcohol, hydrocarbon compounds such as liquid paraffin, paraffin wax, microcrystalline wax and polyethylene wax, silicone oil, etc.

When a cationic resin is contained in the support in the present invention, higher ink absorption can be obtained, which is preferred. Particularly, copolymers such as dimethylamine-epichlorohydrin condensate, dialkylamine-ammonia-epichlorohydrin condensate, acrylamide-diallylamine copolymer, and copolymers having amidine structure one example of which is disclosed in Japanese Patent No. 2624089 have great effect to improve ink absorption and are particularly preferred.

A back coat layer comprising a pigment, binder or the like can also be provided on the back side of the ink jet recording medium of the present invention for inhibition of curling or adjustment of sliding property, whiteness and hue.

Examples of the present invention will be shown below. In the Examples, "part" is "part by mass".

Example 1

Preparation of Lower Layer Coating Composition 6 parts of sodium tetraborate decahydrate (0.97 part in terms of $H_3BO_3$) was dissolved in 350 parts of water, and 100 parts of wet process synthetic silica (FINESEAL X-37B manufactured by Tokuyama Co., Ltd.) was added to the solution, followed by sufficiently dispersing by a dispersing machine having a saw blade. Then, 80 parts (solid content: 40 parts) of styrene-butadiene latex having a solid content of 50% by mass, a glass transition temperature of −15° C. and a gel content of 85% by mass was added to the dispersion, followed by mixing to obtain a lower layer coating composition.

[Preparation of Gas Phase Process Silica Dispersion]

8 parts (solid content: 4 parts) of a 50% aqueous solution of dimethyldiallylammonium chloride polymer having a viscosity of 400 mPa·sec and 100 parts of gas phase process silica (having a specific surface area of 90 $m^2/g$ according to BET method) were added to 392 parts of water with stirring, followed by carrying out preliminary dispersion using a blade-type dispersing machine. The resulting preliminary dispersion was processed by a colloid mill to obtain a gas phase process silica dispersion having a solid concentration of 20.8%. This dispersion was diluted 100 times (mass ratio) with water, sprayed on a glass substrate and observed by a scanning electron microscope to find that 90% or more (in the number) of particles had a long side of 500 nm or less and particles having a long side of 150 nm or more occupied 80% or more of the area occupied by total particles in the field of observation.

[Preparation of Upper Layer Coating Composition]

30 parts (solid content: 3 parts) of a 10 mass % aqueous solution of polyvinyl alcohol having a saponification degree of 88 mol % and a viscosity of 95 mPa·second at 25° C. measured on its 4 mass % aqueous solution was added to 100 parts (solid content: 20.8 parts) of the above resulting gas phase process silica dispersion to prepare an upper layer coating composition.

[Production of Ink Jet Recording Medium]

The lower layer coating composition was coated on a base paper having a basis weight of 157 $g/m^2$ (DIAFORM (trademark) manufactured by Mitsubishi Paper Mills Limited) at a coverage after drying of 10 $g/m^2$, followed by drying using a hot-air drying machine. In this case, the Bekk smoothness was 18 seconds. Then, the upper layer coating composition was coated at a coverage after drying of 8 $g/m^2$, and the coat was pressed onto a chrome-plated cylinder heated to 90° C. in a casting apparatus before vaporization of water under a linear pressure of 20 kN/m and at a rate of 5 m/min and dried until it spontaneously released, thereby obtaining an ink jet recording medium.

Example 2

An ink jet recording medium was produced in the same manner as in Example 1, except that after coating and drying the lower layer, the layer was treated using a soft-calender to give a Bekk smoothness of 35 seconds.

Example 3

An ink jet recording medium was produced in the same manner as in Example 2, except that after coating and drying the lower layer, the layer was treated using a soft-calender to give a Bekk smoothness of 400 seconds.

Example 4

An ink jet recording medium was produced in the same manner as in Example 2, except that after coating and drying the lower layer, the layer was treated using a soft-calender to give a Bekk smoothness of 50 seconds.

Example 5

An ink jet recording medium was produced in the same manner as in Example 2, except that after coating and drying the lower layer, the layer was treated using a soft-calender to give a Bekk smoothness of 100 seconds.

Example 6

An ink jet recording medium was produced in the same manner as in Example 2, except that after coating and drying the lower layer, the layer was treated using a soft-calender to give a Bekk smoothness of 300 seconds.

Example 7

An ink jet recording medium was produced in the same manner as in Example 1, except that 75 parts (solid content: 30 parts) of colloidal silica having a specific surface area of 220 $m^2/g$ measured by BET method and a solid content of 40% by mass was added to the lower layer coating composition.

Example 8

An ink jet recording medium was produced in the same manner as in Example 5, except that 75 parts (solid content: 30 parts) of the same colloidal silica as used in Example 7 was added to the lower layer coating composition.

Example 9

An ink jet recording medium was produced in the same manner as in Example 1, except that 89 parts (solid content: 40 parts) of a latex of 45% by mass in solid content of polyurethane which had a tensile strength of 20 MPa, an elongation of 350% and a particle diameter of 140 nm measured by dynamic light scattering method and which was prepared using polyester polyol as polyol was used in place of the styrene-butadiene latex in the lower layer coating composition.

Example 10

An ink jet recording medium was produced in the same manner as in Example 1, except that 100 parts (solid content: 40 parts) of a latex of 40% by mass in solid content of polyurethane which had a tensile strength of 22 MPa, an elongation of 680% and a particle diameter of 120 nm measured by dynamic light scattering method and which was prepared using polyether polyol as polyol was used in place of the styrene-butadiene latex in the lower layer coating composition.

Example 11

An ink jet recording medium was produced in the same manner as in Example 1, except that 100 parts (solid content: 40 parts) of a latex of 40% by mass in concentration of polyurethane which had a tensile strength of 35 MPa, an elongation of 480% and a particle diameter of 80 nm measured by dynamic light scattering method and which was prepared using polyether polyol as polyol was used in place of the styrene-butadiene latex in the lower layer coating composition.

Example 12

An ink jet recording medium was produced in the same manner as in Example 7, except that 114 parts (solid content: 40 parts) of a latex of 35% by mass in concentration of polyurethane which had a tensile strength of 40 MPa, an elongation of 750% and a particle diameter of 50 nm measured by dynamic light scattering method and which was prepared using polyether polyol as polyol was used in place of the styrene-butadiene latex in the lower layer coating composition.

Example 13

An ink jet recording medium was produced in the same manner as in Example 5, except that 100 parts (solid content: 40 parts) of the same urethane latex as used in Example 10 was used in place of the styrene-butadiene latex in the lower layer coating composition.

Example 14

An ink jet recording medium was produced in the same manner as in Example 5, except that 114 parts (solid content: 40 parts) of the same urethane latex as used in Example 12 was used in place of the styrene-butadiene latex in the lower layer coating composition.

Example 15

An ink jet recording medium was produced in the same manner as in Example 8, except that 100 parts (solid content: 40 parts) of the same urethane latex as used in Example 10 was used in place of the styrene-butadiene latex in the lower layer coating composition.

Example 16

An ink jet recording medium was produced in the same manner as in Example 8, except that 114 parts (solid content: 40 parts) of the same urethane latex as used in Example 12 was used in place of the styrene-butadiene latex in the lower layer coating composition.

Example 17

An ink jet recording medium was produced in the same manner as in Example 8, except that 114 parts (solid content: 40 parts) of a latex of 35% by mass in concentration of polyurethane which had a tensile strength of 50 MPa, an elongation of 600% and a particle diameter of 50 nm measured by dynamic light scattering method and which was prepared using polyether polyol as polyol was used in place of the styrene-butadiene latex in the lower layer coating composition.

Example 18

An ink jet recording medium was produced in the same manner as in Example 16, except that the coverage of the lower layer was 10 g/m$^2$ and that of the upper layer was 15 g/m$^2$.

Example 19

Preparation of Alumina Hydrate Sol 299 parts of water was mixed with 1 part of acetic acid, and 100 parts of alumina hydrate having pseudo-boehmite structure (DISPERAL HP14 manufactured by Sasol Co., Ltd.) was added to the mixture, followed by stirring the mixture as it was for 2 hours to peptize the mixture to obtain an alumina hydrate sol of 25% in solid concentration. This dispersion was diluted 100 times with water, sprayed on a glass substrate, and observed by a scanning electron microscope to find that 90% or more (in the number) of particles had a long side of 400 nm or less and particles having a long side of 100 nm or more occupied 80% or more of the area occupied by total particles in the field of observation.

[Preparation of Upper Layer Coating Composition]

20 parts (solid content: 2 parts) of a 10 mass % aqueous solution of polyvinyl alcohol having a saponification degree of 88 mol % and a viscosity of 95 mPa·sec at 25° C. measured on its 4 mass % aqueous solution was added to 100 parts (solid content: 25 parts) of the resulting alumina hydrate sol to prepare an upper layer coating composition.

[Production of Ink Jet Recording Medium]

The lower layer coating composition of Example 12 was coated on a base paper having a basis weight of 157 g/m$^2$ (DIAFORM (trademark) manufactured by Mitsubishi Paper Mills Limited) by an air-knife coater at a coverage after drying of 10 g/m$^2$, followed by drying using a hot-air drying machine. In this case, the Bekk smoothness was 20 seconds. Then, the upper layer coating composition was coated by an air-knife coater at a coverage after drying of 15 g/m$^2$, followed by drying using a hot-air drying machine. The coated surface of this coated paper was allowed to contact with water for 5 seconds to wet the surface, followed by pressing the coat onto a cylinder heated to 95° C. under a linear pressure of 20 kN/m at a rate of 5 m/min to produce an ink jet recording medium.

Example 20

An ink jet recording medium was produced in the same manner as in Example 19, except that after coating and drying the lower layer, the layer was treated using a calender to give a Bekk smoothness of 100 seconds.

Example 21

An ink jet recording medium was produced in the same manner as in Example 20, except that after coating and drying the upper layer, the layer was treated using a calender to give a Bekk smoothness of 35 seconds.

Example 22

An ink jet recording medium was produced in the same manner as in Example 20, except that after coating and drying the upper layer, the layer was treated using a calender to give a Bekk smoothness of 400 seconds.

Example 23

An ink jet recording medium was produced in the same manner as in Example 20, except that after coating and drying the upper layer, the layer was treated using a calender to give a Bekk smoothness of 50 seconds.

Example 24

An ink jet recording medium was produced in the same manner as in Example 20, except that after coating and drying the upper layer, the layer was treated using a calender to give a Bekk smoothness of 150 seconds.

Example 25

An ink jet recording medium was produced in the same manner as in Example 20, except that after coating and drying the upper layer, the layer was treated using a calender to give a Bekk smoothness of 300 seconds.

Example 26

Preparation of Surface Layer Coating Composition 240 parts of water was added to 60 parts of anionic colloidal silica having an average particle diameter of 22 nm, a solid concentration of 50% by mass and a pH of 9.0, and using $Na^+$ ion as a stabilization ion to prepare a wetting liquid.

[Coating of Surface Layer]

The above surface layer coating composition was coated by a gravure coater at 5 g/m$^2$ (0.5 g/m$^2$ as solid content) as composition on the surface of the ink jet recording medium produced in Example 24, followed by drying with hot air to produce an ink jet recording medium.

Example 27

Preparation of Wetting Liquid 292.5 parts of water was added to 7.5 parts of anionic colloidal silica having an average particle diameter of 75 nm, a solid concentration of 40% by mass and a pH of 9.5 and using $Na^+$ ion as a stabilization ion to prepare a wetting liquid.

[Production of Ink Jet Recording Medium]

An ink jet recording medium was produced in the same manner as in Example 24, except that the above wetting liquid was used in place of water as a wetting liquid in casting treatment. In this case, the coverage of the wetting liquid was 50 g/m$^2$ (0.5 g/m$^2$ as colloidal silica).

Example 28

Preparation of Wetting Liquid 290 parts of water was added to 10 parts of cationic colloidal silica having an average particle diameter of 12 nm, a solid concentration of 30% by mass and a pH of 4.5 and using $Cl^-$ ion as a stabilization ion to prepare a wetting liquid 1.

[Production of Ink Jet Recording Medium]

An ink jet recording medium was produced in the same manner as in Example 24, except that the above wetting liquid was used in place of water as a wetting liquid in casting treatment. In this case, the coverage of the wetting liquid was 50 g/m$^2$ (0.5 g/m$^2$ as colloidal silica).

Example 29

Preparation of Wetting Liquid 294 parts of water was added to 6 parts of anionic colloidal silica having an average particle diameter of 22 nm, a solid concentration of 50% by mass and a pH of 9.0 and using $Na^+$ ion as a stabilization ion to prepare a wetting liquid.

[Production of Ink Jet Recording Medium]

An ink jet recording medium was produced in the same manner as in Example 24, except that the above wetting liquid was used in place of water as a wetting liquid in casting treatment. In this case, the coverage of the wetting liquid was 50 g/m$^2$ (0.5 g/m as colloidal silica).

Example 30

An ink jet recording medium was produced in the same manner as in Example 16, except that 22 parts (5.94 parts as solid content) of a commercially available cationic styrene-acrylate ester copolymer dispersion (solid content: 27% by mass, dispersion particle diameter measured by light scattering method: 50 nm, Tg of resin: 65° C.) was added to the upper layer coating composition.

Example 31

An ink jet recording medium was produced in the same manner as in Example 29, except that the same thermoplastic resin dispersion as used in Example 30 was added to the upper layer coating composition.

Example 32

Preparation of Cationic Treating Solution

A cationic treating solution was prepared by adding 90 parts of water to 60 parts (solid content: 30 parts) of an aqueous solution of dimethylamine-epichlorohydrin condensate of 50% by mass in concentration and 150 parts (solid content: 15 parts) of a 10 mass % aqueous solution of oxidized starch dissolved by usual method.

[Production of Cationically Treated Base Paper]

The above cationic treating solution was coated on both sides of the base paper used in Example 1 at a coverage of 20 g/m$^2$ per one side before drying.

[Production of Ink Jet Recording Medium]

An ink jet recording medium was produced in the same manner as in Example 16, except that the cationically treated base paper was used as the support.

Example 33

An ink jet recording medium was produced in the same manner as in Example 29, except that the same cationically treated base paper as of Example 32 was used as the support.

Comparative Example 1

Preparation of Lower Layer Coating Composition 2 parts of sodium hydroxide was dissolved in 350 parts of water, and 100 parts of wet process synthetic silica (FINESEAL (trademark) X-37B manufactured by Tokuyama Co., Ltd.) was added to the solution, followed by sufficiently dispersing by a dispersing machine having a saw blade. Then, 200 parts (24 parts as nonvolatile content) of a 12% aqueous solution of silyl-modified polyvinyl alcohol (R POLYMER 1130 manufactured by Kuraray Co., Ltd.) having a saponification degree of 98.5% and a viscosity of 25 mPa·sec measured on its 4% aqueous solution was added to the dispersion, followed by mixing to obtain a lower layer coating composition.

[Preparation of Intermediate Layer Coating Composition]

4 parts of sodium tetraborate decahydrate was added to 96 parts of water, followed by stirring and dissolving to prepare an intermediate layer coating composition.

[Production of Ink Jet Recording Medium]

The above lower layer coating composition was coated on a base paper having a basis weight of 157 g/m$^2$ (DIAFORM (trademark) manufactured by Mitsubishi Paper Mills Limited) using an air-knife coater at a coverage after drying of 10 g/m$^2$, followed by drying using a hot-air drying machine. The resulting coated paper had a Bekk smoothness of 20 seconds. Then, the resulting coated paper was treated using soft-calender, and the intermediate layer coating composition was coated at a coverage after drying of 0.2 g/m$^2$, followed by drying using a hot-air drying machine. Furthermore, the upper layer coating composition of Example 1 was coated using an air-knife coater to give a mass of 8 g/m$^2$ after drying, followed by drying using a hot-air drying machine. Further, the resulting coated paper was treated using a soft-calender. The coated surface of this coated paper was wetted by contacting with water for 5 seconds, and then was pressed onto a chrome-plated cylinder having specular surface and heated to 90° C. in a casting apparatus under a linear pressure of 20 kN/m and at a rate of 5 m/min, and the coated paper was released from the cylinder after drying to obtain an ink jet recording medium.

Comparative Example 2

Preparation of Intermediate Layer Coating Composition 2 parts of boric acid was added to 98 parts of water, followed by stirring and dissolving to prepare an intermediate layer coating composition.

[Production of Ink Jet Recording Medium]

An ink jet recording medium was produced in the same manner as in Comparative Example 1, except that in place of the intermediate coating composition of Comparative Example 1, the above intermediate layer coating composition was coated at a coverage of 0.1 g/m$^2$ after drying.

Comparative Example 3

An ink jet recording medium was produced in the same manner as in Comparative Example 1, except that the coverage of the upper layer after drying was 15 g/m$^2$.

Comparative Example 4

An ink jet recording medium was produced in the same manner as in Comparative Example 1, except that the coverage of coating of the upper layer after drying was 20 g/m$^2$.

Comparative Example 5

An ink jet recording medium was produced in the same manner as in Comparative Example 4, except that after coating and drying the lower layer, the layer was treated using a soft-calender to give a Bekk smoothness of 100 seconds after the treatment.

COMPARATIVE EXAMPLE 6

An ink jet recording medium was produced in the same manner as in Comparative Example 1, except that a lower layer coating composition prepared in the same manner as in Example 16, except that the sodium tetraborate was not added was used as the lower layer coating composition.

Comparative Example 7

The lower layer coating composition of Comparative Example 1 was coated on a base paper having a basis weight of 157 g/m$^2$ (DIAFORM (trademark) manufactured by Mitsubishi Paper Mills Limited) using an air-knife coater at a coverage after drying of 10 g/m$^2$, followed by drying using a hot-air drying machine. Then, the resulting coated paper was treated using soft-calender, and thereafter, the intermediate layer coating composition of Comparative Example 1 was coated to at a coverage after drying of 0.2 g/m$^2$, followed by drying using a hot-air drying machine. Thereon, the upper layer coating composition of Example 19 was coated at a coverage after drying of 15 g/m$^2$. Before water vaporized, the coat was pressed onto a chrome-plated cylinder having specular surface and heated to 90° C. in a casting apparatus under a linear pressure of 20 kN/m and at a rate of 5 m/min, and the coated paper was released from the cylinder after drying to obtain an ink jet recording medium.

Comparative Example 8

An ink jet recording medium was produced in the same manner as in Comparative Example 7, except that the intermediate layer coating composition of Comparative Example 2 was coated in place of the intermediate layer coating composition of Comparative Example 1 at a coverage after drying of 0.1 g/m$^2$.

Comparative Example 9

An ink jet recording medium was produced in the same manner as in Comparative Example 7, except that the coverage of coating of the upper layer after drying was 25 g/m$^2$.

Comparative Example 10

An ink jet recording medium was produced in the same manner as in Comparative Example 7, except that the coverage of coating of the lower layer after drying was 25 g/m$^2$.

Comparative Example 11

An ink jet recording medium was produced in the same manner as in Comparative Example 7, except that the coverage of coating of the lower layer after drying was 20 g/m$^2$ and the coverage of coating of the upper layer after drying was 20 g/m$^2$.

Comparative Example 12

An ink jet recording medium was produced in the same manner as in Comparative Example 7, except that a lower layer coating composition prepared in the same manner as in Example 16, except that sodium tetraborate was not added was used as the lower layer coating composition.

[Evaluation of Gloss]

Evaluation of gloss was conducted by measuring image clarity which is high in correlation with visual sensation. For measurement, an image clarity tester was used with an angle of reflection of 600 and a width of slit of 1.0 mm.

[Evaluation of Ink Absorption]

A given image to be evaluated was printed using PM-G800 type ink jet printer manufactured by Seiko Epson Corporation, and ink absorption of each recording medium was evaluated by grading into the following five criteria: A (very good), B (good), C (ordinary), D (acceptable), and E (unacceptable). When the ink absorption was relatively superior at the same grade, this is indicated, for example, by B+, and when it was relatively inferior at the same grade, this is indicated, for example, by B−.

[Evaluation on Low Dust Formation]

Ten cuts of 2 cm in length were made in the ink jet recording medium on a black paper by a craft knife with blade snap function (A-300 manufactured by NT Co., Ltd.). Dusts formed were collected, and according to the amount of the dusts, the dust formation was graded into A (very small), B (small), C (ordinary), D (large), and E (very large). When it was relatively smaller at the same grade, this is indicated, for example, by B+, and when it was relatively larger at the same grade, this is indicated, for example, by B−.

[Evaluation of Frictional Resistance]

Each ink jet recording medium of the above examples and comparative examples was placed on a flat table with the recorded surface facing upward, and the same base paper as used in Example 1 was put on the recorded surface. Thereon was placed a cylindrical weight having a mass of 1 kg and a diameter of 53 mm, and after the weight was dragged at a rate of 5 cm/sec in horizontal direction, the surface of the recording medium was observed, and the state of the surface was graded into the following five criteria according to the change of texture of the surface: A (no change was seen) to E (clear change was seen).

The results of evaluation of the ink jet recording media obtained in the examples and comparative examples are shown in Table 1.

By comparing the examples and comparative examples, particularly, Example 1 with Comparative Examples 1, 2 and 6, and Example 19 with Comparative Examples 7, 8 and 12, it can be seen that ink jet recording media having high gloss and sufficient ink absorption can be obtained with small coverage of coating according to the present invention. Ink absorption and gloss equal to those obtained by the present invention can also be obtained by increasing the coverage of coating of lower layer and upper layer according to conventional technique as in Comparative Examples 4 and 5 and Comparative Examples 9 and 11. However, in the case of the conventional technique, the low dust formation can hardly be attained.

By comparing Example 1 with Examples 2-6, Example 7 with Example 8, Example 10 with Example 13, Example 12 with Example 16, and Example 19 with Example 20, respectively, it can be seen that the higher gloss and superior low dust formation can be attained by carrying out calendering treatment after coating and drying the lower layer in the present invention.

It can be seen by comparing Examples 2 and 3 with Examples 4-6 that gloss, low dust formation and ink absorption can be simultaneously attained when the calendering treatment of the lower layer is carried to give a Bekk smoothness in the range of 50-300 seconds.

By comparing Example 1 with Example 7, Example 5 with Example 8, Example 13 with Example 15, and Example 14 with Example 16, it can be seen that the higher ink absorption and lower dust formation can be attained by containing colloidal silica in the lower layer coating composition in the present invention.

By comparing Example 1 with Examples 9-11, Example 7 with Example 12, Example 5 with Examples 13 and 14, and Example 8 with Examples 13-18, it can be seen that ink jet recording media particularly excellent in gloss can be obtained by using a latex of polyurethane resin as a latex in the lower layer coating composition of the present invention.

It can be seen by comparing Example 9 with Example 10 that ink jet recording media having excellent low dust formation can be obtained by using a latex of polyurethane resin prepared using polyether polyol as polyol as a latex used in the lower layer coating composition of the present invention.

By comparing Examples 9 and 10 with Examples 11, Example 13 with Example 14, and Example 15 with Examples 16 and 17, it can be seen that ink jet recording media particularly excellent in low dust formation can be obtained by using a latex of polyurethane resin which has a tensile strength of 30-70 MPa and an elongation of 300-800% as a latex used in the lower layer coating composition of the present invention.

By comparing Example 11 with Examples 12, it can be seen that ink jet recording media further excellent in low dust formation can be obtained by using a latex of polyurethane resin which has a particle diameter of 10-60 nm measured by dynamic light scattering method as a latex used in the lower layer coating composition of the present invention.

By comparing Example 18 with Example 20, it can be seen that ink jet recording media particularly excellent in gloss can be obtained by using an alumina hydrate as a submicron pigment in the upper layer coating composition of the present invention, and carrying out the casting treatment by rewet method.

By comparing Example 20 with Examples 21-25, it can be seen that high gloss and frictional resistance can be obtained by carrying out calendering treatment after coating and drying the upper layer in the case of using an alumina hydrate as a submicron pigment in the upper layer coating composition of the present invention and carrying out the casting treatment by rewet method.

By comparing Example 21 and 22 with Examples 23-25, it can be seen that ink absorption and frictional resistance can be simultaneously attained by adjusting the Bekk smoothness of the surface of the upper layer after calendering treatment to the range of 50-300 seconds in the case of using an alumina hydrate as a submicron pigment of the upper layer coating composition of the present invention and carrying out the casting treatment by rewet method after calendering treatment after coating and drying the upper layer.

By comparing Example 24 with Examples 26-29, it can be seen that ink jet recording media high in frictional resistance can be obtained by carrying out rewetting treatment with a wetting liquid containing colloidal silica in the case of using an alumina hydrate as a submicron pigment in the upper layer coating composition of the present invention, and carrying out the casting treatment by rewet method.

By comparing Examples 26-28 with Examples 29, it can be seen that ink jet recording media further higher in gloss and frictional resistance can be obtained by carrying out rewetting treatment with an aqueous liquid containing anionic colloidal silica in the case of using an alumina hydrate as a submicron pigment in the upper layer coating composition of the present invention, and carrying out the rewet casting treatment with rewetting treatment with an aqueous liquid containing colloidal silica.

By comparing Example 16 with Example 30 and Example 29 with Example 31, it can be seen that ink jet recording media excellent in print density and in low dust formation can be obtained by containing a thermoplastic resin in the upper layer coating composition in the present invention.

By comparing Example 16 with Example 32 and Example 29 with Example 33, it can be seen that ink jet recording media particularly excellent in ink absorption can be obtained by containing a cationic resin in the support in the present invention.

TABLE 1

| | Example 1 | Example 2 | Example 3 | Example 4 | Example 5 | Example 6 |
|---|---|---|---|---|---|---|
| Gloss | 65 | 68 | 73 | 70 | 71 | 72 |
| Ink absorption | C | C | E | C− | C− | D+ |
| Low dust formation | D− | D+ | C+ | C− | C− | C+ |
| Frictional resistance | A− | A− | A− | A− | A− | A− |
| Print density | 2.02 | 2.05 | 2.15 | 2.08 | 2.1 | 2.13 |

| | Example 7 | Example 8 | Example 9 | Example 10 | Example 11 | Example 12 |
|---|---|---|---|---|---|---|
| Gloss | 67 | 73 | 69 | 70 | 70 | 72 |
| Ink absorption | A+ | A | C | C | C | A+ |
| Low dust formation | D+ | C+ | C− | C+ | B | A− |

TABLE 1-continued

| | | | | | | |
|---|---|---|---|---|---|---|
| Frictional resistance | A− | A− | A− | A− | A− | A− |
| Print density | 1.98 | 2.07 | 2.05 | 2.06 | 2.06 | 2.07 |

TABLE 2

| | Example 13 | Example 14 | Example 15 | Example 16 | Example 17 | Example 18 |
|---|---|---|---|---|---|---|
| Gloss | 76 | 77 | 77 | 78 | 77 | 79 |
| Ink absorption | C− | C− | A | A | A | A |
| Low dust formation | B | A | B+ | A+ | A+ | A− |
| Frictional resistance | A− | A− | A− | A− | A− | A− |
| Print density | 2.11 | 2.12 | 2.09 | 2.11 | 2.10 | 2.05 |

| | Example 19 | Example 20 | Example 21 | Example 22 | Example 23 | Example 24 |
|---|---|---|---|---|---|---|
| Gloss | 82 | 84 | 88 | 92 | 90 | 91 |
| Ink absorption | A+ | A | A | B− | A− | A |
| Low dust formation | A− | A+ | A+ | A+ | A+ | A+ |
| Frictional resistance | D | D | C− | B+ | C+ | B− |
| Print density | 2.15 | 2.17 | 2.18 | 2.25 | 2.20 | 2.22 |

TABLE 3

| | Example 25 | Example 26 | Example 27 | Example 28 | Example 29 |
|---|---|---|---|---|---|
| Gloss | 92 | 71 | 91 | 91 | 95 |
| Ink absorption | B+ | B− | A | A | A |
| Low dust formation | A+ | A+ | A+ | A+ | A+ |
| Frictional resistance | B | A− | A− | A− | A+ |
| Print density | 2.23 | 2.20 | 2.20 | 2.20 | 2.23 |

| | Example 30 | Example 31 | Example 32 | Example 33 |
|---|---|---|---|---|
| Gloss | 78 | 96 | 77 | 95 |
| Ink absorption | A+ | A | A+ | A+ |
| Low dust formation | A+ | A+ | A+ | A+ |
| Frictional resistance | A− | A+ | A− | A+ |
| Print density | 2.20 | 2.27 | 2.08 | 2.21 |

TABLE 4

| | Comparative Example 1 | Comparative Example 2 | Comparative Example 3 | Comparative Example 4 | Comparative Example 5 | Comparative Example 6 |
|---|---|---|---|---|---|---|
| Gloss | 50 | 51 | 55 | 60 | 65 | 57 |
| Ink absorption | D− | D− | D+ | C | B− | C |
| Low dust formation | D | D− | E+ | E | E− | E− |

TABLE 4-continued

| | | | | | | |
|---|---|---|---|---|---|---|
| Frictional resistance | A+ | A+ | A | A | A | A |
| Print density | 1.95 | 1.97 | 1.88 | 1.82 | 1.79 | 1.8 |
| | Comparative Example 7 | Comparative Example 8 | Comparative Example 9 | Comparative Example 10 | Comparative Example 11 | Comparative Example 12 |
| Gloss | 48 | 48 | 65 | 53 | 62 | 50 |
| Ink absorption | D− | D− | B− | C | C+ | D+ |
| Low dust formation | D | D | E− | E− | E− | D |
| Frictional resistance | D− | D− | D− | D− | D− | D− |
| Print density | 1.93 | 1.91 | 1.83 | 1.83 | 1.75 | 1.92 |

The invention claimed is:

1. An ink jet recording medium produced by providing a lower layer and an upper layer on an air permeable support and then subjecting the upper layer to casting treatment, wherein the lower layer is provided by coating a coating composition containing a water-absorptive pigment, colloidal silica a latex and boric acid or a salt thereof, and the upper layer is provided by coating a coating composition containing a submicron pigment and a polyvinyl alcohol.

2. An ink jet recording medium according to claim 1, wherein the water-absorptive pigment in the lower layer is a wet process synthetic silica.

3. An ink jet recording medium according to claim 1, wherein the support provided with the lower layer is subjected to calendering treatment after coating the lower layer and before coating the upper layer.

4. An ink jet recording medium according to claim 3, wherein the surface of the lower layer after subjected to calendering treatment has a Bekk smoothness of 50-300 seconds.

5. An ink jet recording medium according to claim 1, wherein the latex in the lower layer coating composition is a latex of a polyurethane resin.

6. An ink jet recording medium according to claim 5, wherein the latex of a polyurethane resin is prepared using a polyether polyol as a starting material.

7. An ink jet recording medium according to claim 5, wherein the polyurethane resin has a tensile strength of 30-70 MPa and an elongation of 300-800% specified in JIS K 7311.

8. An ink jet recording medium according to claim 5, wherein the polyurethane resin has a particle diameter of 10-60 nm measured by a dynamic light scattering method.

9. An ink jet recording medium according to claim 1, wherein the submicron pigment in the upper layer coating composition is an alumina hydrate and the upper layer is subjected to casting treatment by a rewet method.

10. An ink jet recording medium according to claim 9, wherein the support provided with the lower layer and the upper layer is subjected to calendering treatment after coating the upper layer and before subjected to the casting treatment.

11. An ink jet recording medium according to claim 10, wherein the surface of the upper layer after subjected to the calendering treatment has a Bekk smoothness of 50-300 seconds.

12. An ink jet recording medium according to claim 11, wherein the upper layer is rewetted with a rewetting liquid containing colloidal silica.

13. An ink jet recording medium according to claim 12, wherein the colloidal silica in the rewetting liquid is an anionic colloidal silica having an average primary particle diameter of 40 nm or less.

14. An ink jet recording medium according to claim 1, wherein the upper layer coating composition contains a cationic aqueous dispersion of at least one resin selected from (1) (meth)acrylate ester polymers, (2) styrene-(meth)acrylate ester copolymers and (3) polyurethanes, said dispersion having a particle diameter of 150 nm or less measured by a dynamic light scattering method.

15. An ink jet recording medium according to claim 1, wherein the support contains a cationic resin.

* * * * *